United States Patent [19]

Walter et al.

[11] 4,260,875

[45] Apr. 7, 1981

[54] CONTROLLED TEMPERATURE HAIR DRYER

[75] Inventors: Henry J. Walter, Wilton; Raymond W. Kunz, Monroe; Richard E. Shoemaker, Westport, all of Conn.

[73] Assignee: Clairol Incorporated, New York, N.Y.

[21] Appl. No.: 916,994

[22] Filed: Jun. 19, 1978

[51] Int. Cl.[3] ..... A45D 20/10; H05B 1/02

[52] U.S. Cl. ..... 219/364; 34/48; 34/98; 219/370; 219/501

[58] Field of Search ..... 219/364, 368, 369–382, 219/501, 366; 34/48, 96–98, 243 R; 132/9, 11 R

[56] References Cited

U.S. PATENT DOCUMENTS

| | | | |
|---|---|---|---|
| 2,594,101 | 4/1952 | Volker | 219/370 |
| 3,082,540 | 3/1963 | Hiltenbrand | 219/368 |
| 3,426,441 | 2/1969 | Broski | 34/48 |
| 3,524,044 | 8/1970 | Liardi | 219/368 |
| 3,543,005 | 11/1970 | Kelemen | 219/494 |
| 3,548,157 | 12/1970 | Lauck | 219/501 |
| 3,588,446 | 6/1971 | Mills et al. | 219/501 |
| 3,769,494 | 10/1973 | Janson | 219/364 |
| 3,920,955 | 11/1975 | Nakata | 219/501 |
| 3,937,989 | 2/1976 | Meijer | 219/501 |
| 3,943,329 | 3/1976 | Hlavac | 219/368 |
| 3,946,200 | 3/1976 | Juodikis | 219/501 |
| 4,045,652 | 8/1977 | Janson | 219/364 |

*Primary Examiner*—B. A. Reynolds
*Assistant Examiner*—Bernard Roskoski
*Attorney, Agent, or Firm*—Gerald S. Rosen; George A. Mentis

[57] ABSTRACT

A hair dryer, the temperature of the air stream from which is automatically controlled by the temperature of the hair being dried, is provided. The dryer includes a primary air inlet, a fan for blowing inlet air out of the dryer, and a heater by which the blown air is heated before it is directed against a user's hair. The dryer also includes a feedback air duct and a thermistor positioned in the duct to sense the temperature of the air being reflected off the user's hair as it is dried. In accordance with the temperature of the reflected air, the thermistor changes resistance, which change is sensed by an integrated circuit zero crossing switch that electronically signals a thyristor causing the thyristor either to switch off or proportionally reduce the power to the heater, and therefore the amount of heat energy input in the blown air. Consequently, the temperature of the air being blown against the user's hair is continuously monitored as the hair dries to avoid the hair and scalp from becoming overheated.

2 Claims, 4 Drawing Figures

CONTROLLED TEMPERATURE HAIR DRYER

BACKGROUND OF THE INVENTION

This invention relates to a hair dryer. More specifically it relates to a hair dryer having means for sensing the temperature of hair being dried, so that the temperature of the drying air coming from the dryer is automatically reduced in accordance with the sensed temperature.

Hair drying is the removal of water from hair, such as after the hair has been washed. Some of the water in the hair is loose, bridging the hairs, and some is absorbed in each hair. Loose water, for the most part, can be removed by mechanical means, such as towel drying, combing or brushing. Absorbed water is best removed by evaporation. The rate of evaporation is a function of the heat energy delivered to the hair, which raises its temperature to first break the bond of the water with the hair (heat of sorption) and to then convert the water into vapor.

If an air stream of constant temperature is directed against wet hair, most of the heat energy of the air stream will be absorbed by the hair causing the temperature of the air reflected off the hair to be considerably lower than that of the hair stream. As evaporation proceeds and the hair dries, less of the heat energy of the air stream will be absorbed by the hair resulting in a high temperature of the reflected air, until finally, when most of the water is evaporated the temperature of the reflected air approaches the temperature of the air stream. By continuously sampling the temperature of the reflected air and controlling power to the heater, the dryer of this invention protects the hair and scalp from being overheated. In addition, the temperature of the reflected air at a given distance may serve as a measure of the dryness of the hair.

Because the flexibility of hair decreases with its dryness, excessive drying can contribute to its damage. Further, while hair can withstand high temperatures (160° C. to 180° C.), the scalp exhibits pain sensations at air temperatures above 50° C. When the hair is wet, the heat of the hair dryer air stream is absorbed by the water in and on the hair, so that no pain is felt by the user. However, when the hair is dry, it is heated faster and the air stream reaches the scalp, thereby possibly causing some pain.

U.S. Pat. No. 3,426,441, issued to Broski, describes a hair dryer that utilizes a thermistor for measuring the temperature of ambient air. U.S. Pat. No. 3,082,540, issued to Hiltenbrand, describes a hair dryer that measures the humidity of air that has already passed through hair being dried. Neither of these dryers, nor any other dryer of the prior art, is known to measure the temperature of air reflected off hair being dried, as does the dryer of the present invention. In response to such temperature measurement, the latter dryer is capable of automatically controlling the temperature of the hair and scalp during the drying operation, with the added advantage of limiting the level of dryness of the hair.

SUMMARY OF THE INVENTION

A hair dryer is provided which comprises a fan for blowing air out of the dryer and against a person's hair and a heater for heating the air before it is blown out of the dryer. Further, it comprises means for sensing the temperature of air being reflected off the person's hair as the hair is dried. The device further comprises means operatively connected to the sensing means for regulating the heat output of the heater in accordance with the temperature of the reflected air, whereby as the hair is dried, the temperature of the air being blown out of the dryer is reduced to prevent excessive heating of the hair and scalp and limiting the level of dryness of the hair.

DETAILED DESCRIPTION OF THE INVENTION

Figure 1:
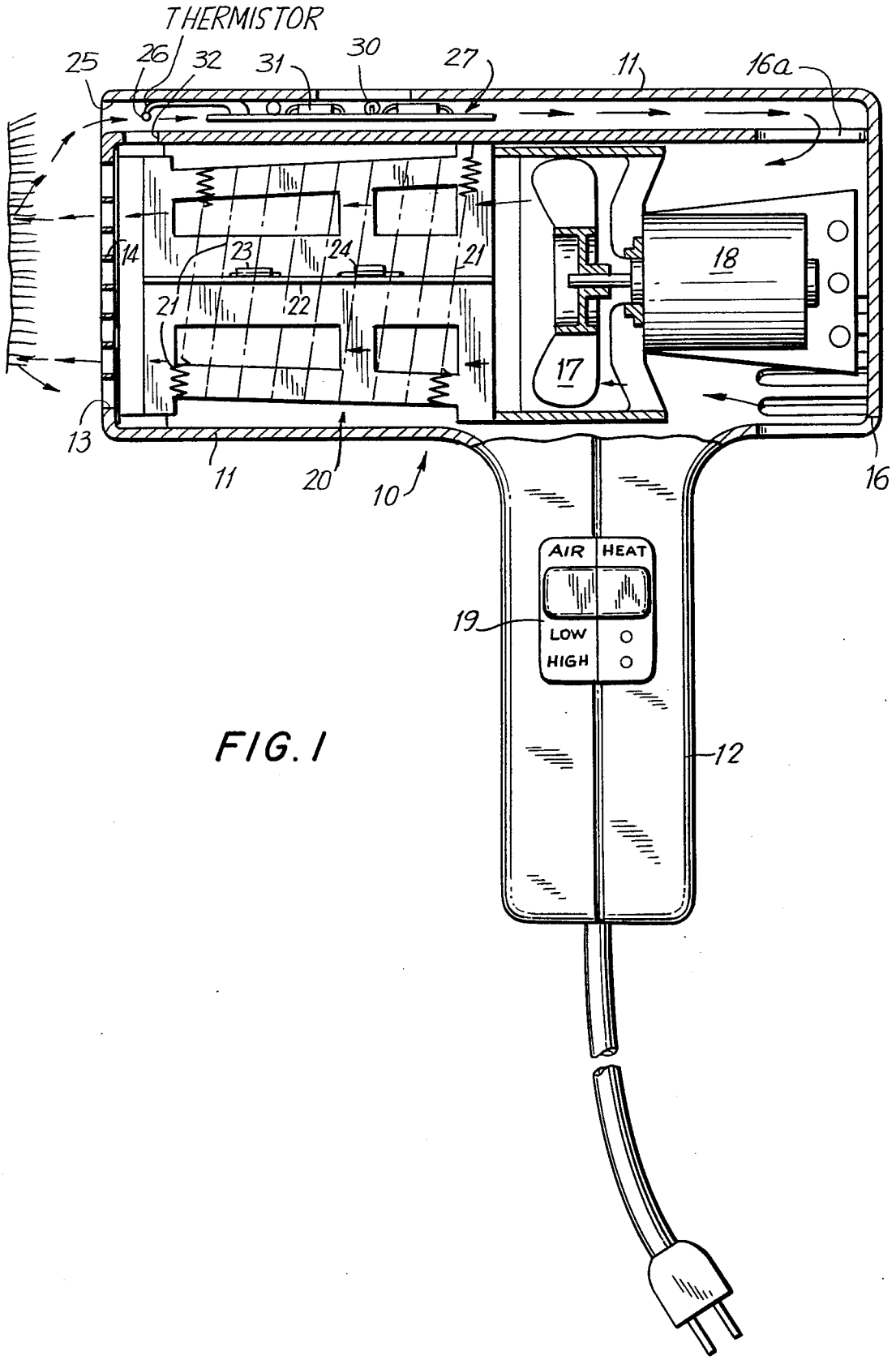
FIG. 1 is a partially broken-away, side view of a hair dryer of the present invention.
Figure 2:
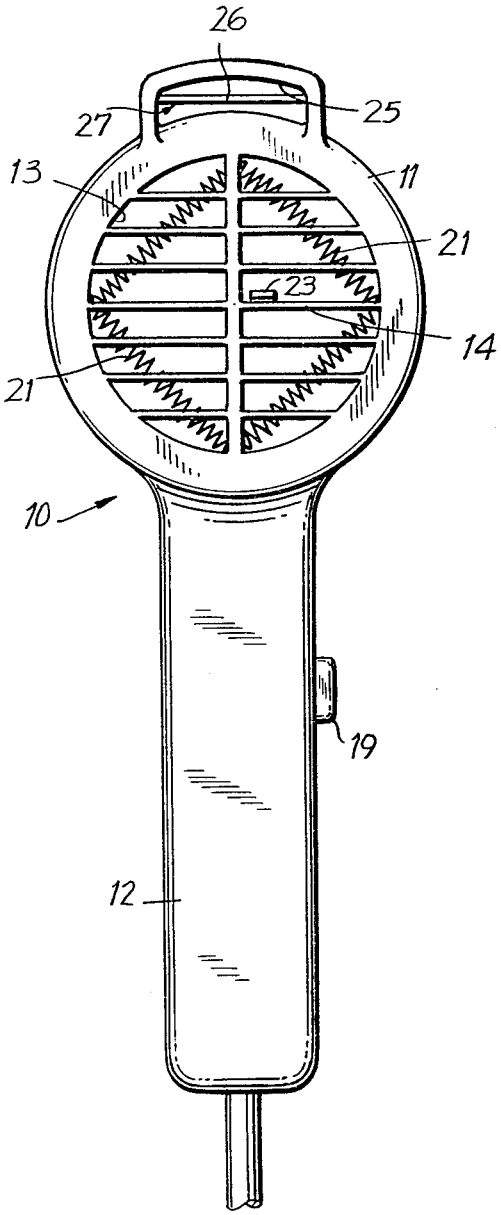
FIG. 2 is a front view of the dryer of FIG. 1.
Figure 3:
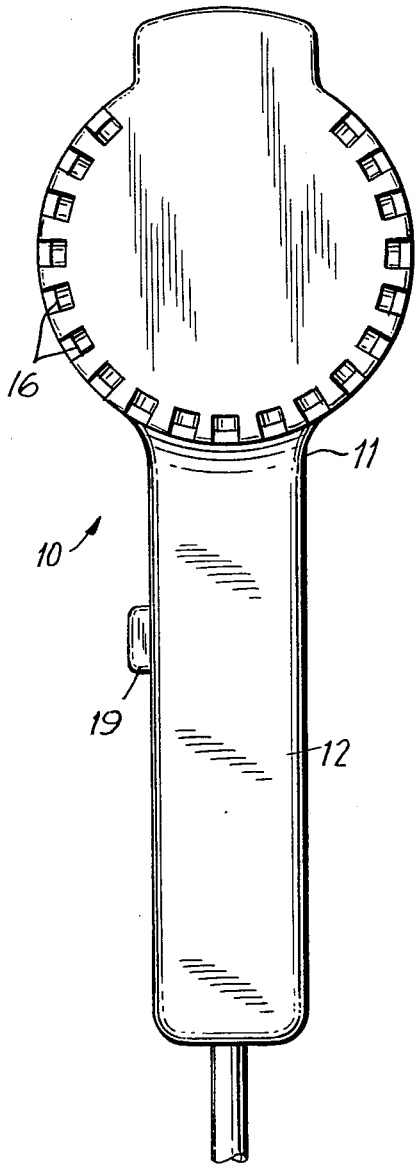
FIG. 3 is a rear view of the dryer of FIG. 1.

A hair dryer 10 of this invention is shown in FIG. 1. The dryer has a housing 11, which defines a handle 12 and air inlets and an air outlet. As best shown in FIG. 2, an air outlet 13 is defined in the front portion of the dryer. Disposed in outlet 13 is an exhaust grill 14. As best shown in FIG. 3, several primary air inlets 16 are defined in the rear portion of the dryer through which air is drawn into the dryer by a fan 17. The fan is powered by a fan motor 18 that receives electrical current through a conventional electrical cord (not shown) when the cord is plugged into a power source. A dual-switch 19 is provided in handle 12. Switch 19 conventionally controls fan speed and power to the heater. Forward of fan 17 near air outlet 13 is a heater assembly, generally indicated at 20. The heater assembly includes several heater coils 21 supported on a heater support board 22. Also supported on the board and electrically connected to ccils 21 are a thermostat 23 and fuse 24, which additionally insure that the heater assembly does not overheat.

Housing 11 further defines a feedback air duct 25. Positioned in the duct adjacent air outlet 13 is a thermistor 26, which is part of a temperature sensing circuit, generally indicated at 27. In the rear portion of duct 25 adjacent primary air inlets 16 is a secondary air inlet **16*a***.

Feedback air duct 25, thermistor 26, and temperature sensing circuit 27 provide a means for determining the temperature of air being reflected off the user's hair as it is dried.

As indicated by arrows in FIG. 1, air entering inlets 16 is drawn into fan 17 and blown by the fan past heating coils 21. The air thus heated by the coils is blown out through outlet 13 against first the user's hair and then the scalp. Some of the air drying the hair is reflected back into the dryer through duct 25, particularly because of the suction effect created by fan 17. The reflected air in duct 25 is eventually circulated into the dryer through secondary air inlet **16*a***, but may also be exhausted without entering the dryer if that is desired.

Figure 4:
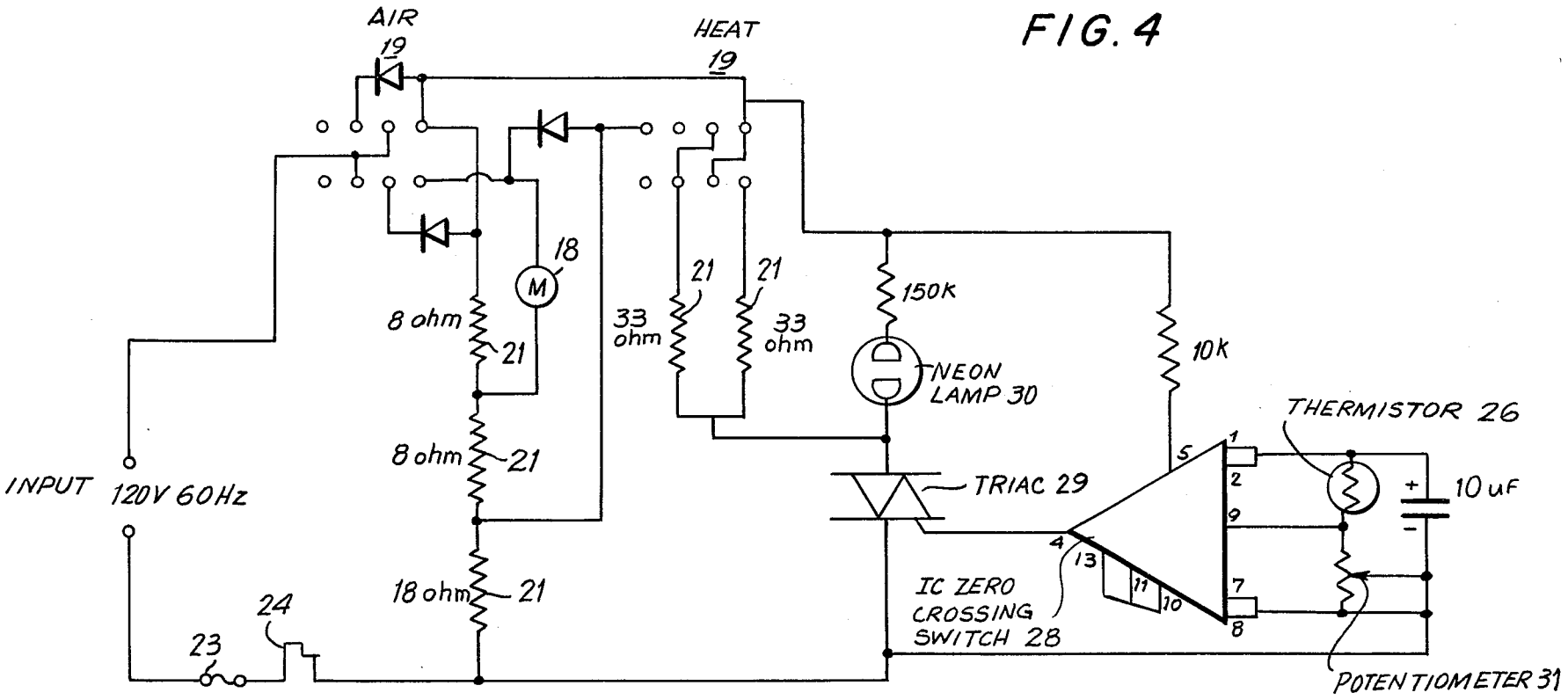
FIG. 4 is a schematic view of the electronic circuitry of the dryer of FIG. 1.

Thermistor 26 and temperature sensing circuit 27 are shown schematically in FIG. 4. Thermistor 26 is preferably a negative temperature coefficient resistor, but may also be a positive temperature coefficient resistor. Such a thermistor is available from the Fenwall Electronics Corp., Waltham, MA, under the name "Model GA51L2". Proceeding right to left with reference to FIG. 4, thermistor 26 senses the temperature of the air being reflected off the user's hair as the dryer is used. In response to that temperature, the resistance of the thermistor changes. This change is detected by an integrated circuit zero crossing switch 28, which is composed of a comparator and a differential amplifier. Such a useful sensing circuit is available from the RCA Corporation, Sommerville, NJ, under the name "CA-3079". Swtich 28 electrically provides a controlling signal to the thyristor 29, which cuts off or reduces the power to heater coils 21, thereby cutting off or reducing heat input into the air stream from the dryer. Such a thyristor is available from the RCA Corporation under the name of "Triac T-20800b".

By varying the power to the heater, the temperature of the air being blown against the user's hair is reduced as the hair dries. Consequently, even though the user may operate switch 19 to select a high fan speed and a high level of heat of the air being blown out of the dryer, the dryer automatically reduces the temperature of the air stream in accordance with the reflected air temperature from the hair to prevent the hair and scalp from being overheated. Additionally, a neon lamp 30 is provided for indicating to the user when the heater is on or off and a potentiometer 31 is provided by which the sensitivity to temperature changes of thermistor 26 can be adjusted. Further, an opening 32 may be provided as shown in FIG. 1, between the heater area and duct 25 to allow thermistor 26 to sense the temperature of air deflected from the heater area and into the duct, if outlet 13 is blocked.

What is claimed is:

1. A hand held hair dryer comprising a housing, said housing defining an air inlet, an air outlet and a handle;

a fan disposed in said housing for drawing air through the air inlet into the housing and blowing it out the air outlet and against a person's hair;

a heater for heating the air before it is blown out of the dryer disposed in said housing between the fan and the air outlet;

a feedback air duct, adjacent the air outlet, having a thermistor positioned therein for sensing the temperature of air being reflected off the person's hair and drawn into the feedback air duct at the front of the hair dryer as the hair is dried; and means operatively connected to the thermistor means for regulating the heat output of the heater by gradually reducing its power output in accordance with the temperature of the reflected air, whereby as the hair is dried the temperature of the air being blown out of the hair dryer is reduced to prevent the hair from being overheated.

2. The dryer of claim 1 wherein the heat output regulating means comprises an integrated circuit zero crossing switch, which measures the resistance of the thermistor, and a thyristor, which cuts off or gradually reduces the power output of the heater, the switch directing the thyristor to cut off or reduce the power output of the heater in accordance with the resistance of the thermistor.

* * * * *